US010330361B2

(12) United States Patent
Cho

(10) Patent No.: US 10,330,361 B2
(45) Date of Patent: Jun. 25, 2019

(54) PASSIVE LIQUID COLLECTING DEVICE

(71) Applicant: HAMILTON SUNDSTRAND CORPORATION, Charlotte, NC (US)

(72) Inventor: Wei-Lin Cho, Unionville, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 206 days.

(21) Appl. No.: 15/416,124

(22) Filed: Jan. 26, 2017

(65) Prior Publication Data

US 2018/0209744 A1 Jul. 26, 2018

(51) Int. Cl.
*B01D 53/22* (2006.01)
*F25B 43/00* (2006.01)

(52) U.S. Cl.
CPC ..... *F25B 43/006* (2013.01); *F25B 2400/23* (2013.01)

(58) Field of Classification Search
CPC ..... F25B 2400/23; F25B 43/006; F28F 27/02; F28F 2250/06; F28D 15/0266; F28D 2021/0021
See application file for complete search history.

(56) References Cited

U.S. PATENT DOCUMENTS 1,715,828 A * 6/1929 Gay ..... F25B 39/02 62/117
2,503,212 A * 4/1950 Patterson ..... F25B 5/02 62/204
2,764,476 A * 9/1956 Etter ..... B01J 19/0013 165/109.1
3,234,752 A * 2/1966 Quick ..... F25B 1/10 62/192
3,587,244 A * 6/1971 Wood ..... F25B 41/00 137/386
3,984,051 A 10/1976 Labbe et al.
4,613,438 A 9/1986 DeGraffenreid
4,749,485 A 6/1988 DeGraffenreid
5,303,768 A 4/1994 Alario et al.
5,901,557 A 5/1999 Grayson
6,052,992 A 4/2000 Eroshenko
6,615,609 B2 9/2003 Kawasaki et al.
(Continued)

FOREIGN PATENT DOCUMENTS

CN 102514733 6/2012
JP H0539099 A 2/1993
(Continued)

*Primary Examiner* — Anthony R Shumate
(74) *Attorney, Agent, or Firm* — Carlson, Gaskey & Olds, PC.

(57) ABSTRACT

A passive liquid collecting device includes a reservoir including a reservoir exit line and at least one rigid structure disposed within the reservoir configured to collect a liquid and direct the liquid to the reservoir exit line. A first porous capillary media is supported by the at least one rigid structure and a vapor-liquid separator in contact with at least one of the at least one rigid structure and the first porous capillary media. The vapor-liquid separator includes a guide member extending along a guide member axis having a guide inlet and a guide outlet connected by a spiral conduit. A second porous capillary media is located radially outward from the spiral conduit on an exterior surface of the guide member. A thermal control loop is also disclosed.

20 Claims, 11 Drawing Sheets

(56) References Cited

U.S. PATENT DOCUMENTS

| | | | | |
|---|---|---|---|---|
| 6,990,816 | B1 | 1/2006 | Zuo et al. | |
| 9,103,602 | B2 | 8/2015 | Kroliczek et al. | |
| 9,108,144 | B2 | 8/2015 | Behruzi et al. | |
| 2005/0120733 | A1* | 6/2005 | Healy | F25B 1/04 62/324.4 |
| 2007/0039336 | A1* | 2/2007 | Wu | F25B 1/04 62/160 |
| 2007/0039347 | A1* | 2/2007 | Robertson Abel | F25B 1/04 62/324.1 |
| 2007/0157808 | A1 | 7/2007 | Wagner et al. | |
| 2008/0092573 | A1* | 4/2008 | Vaisman | F25B 1/10 62/222 |
| 2015/0285539 | A1* | 10/2015 | Kopko | F25B 5/02 62/115 |
| 2016/0109160 | A1* | 4/2016 | Junge | F25B 13/00 62/324.6 |
| 2017/0003040 | A1* | 1/2017 | Chaudhry | F25B 13/00 |
| 2018/0023850 | A1* | 1/2018 | Chaudhry | F25B 13/00 62/262 |

FOREIGN PATENT DOCUMENTS

| | | |
|---|---|---|
| JP | H0549809 A | 3/1993 |
| RU | 2117891 | 8/1998 |
| RU | 2346862 C2 | 9/2008 |

* cited by examiner

56

PASSIVE LIQUID COLLECTING DEVICE

BACKGROUND

This application relates to a passive liquid collecting device for separating and collecting liquid from a mixture of liquid and vapor.

In microgravity and zero gravity environments, fluids tend to distribute throughout the reservoir storing the fluid. Some of the fluid, such as liquid, will attach to a wall of the reservoir, and the rest of the fluid will float throughout a cavity defined by the reservoir. The distribution of fluids attached to the reservoir wall and floating in the cavity can raise challenges when drawing a liquid phase of the fluid from the reservoir.

Two phase chiller systems, sometimes called thermal control loops, frequently have accumulators which collect both liquid and vapor refrigerant. The two phase chiller systems may be damaged or operate less efficiently if they draw a mixture of liquid and vapor from the accumulator instead of drawing liquid. Specifically, delivery of vapor to a pump within a chiller system may cause pump cavitation.

In addition to chiller systems, vapor-liquid phase separation is used in the oil and gas industry, various chemical manufacturing and treatment processes, fuel management systems, and numerous other applications. For example, in many chemical manufacturing and treatment processes, liquid and vapor phases are separated and directed along different paths for further individual processing or treatment.

A known solution for separating liquid from vapor is a structure that operates through capillary material. The capillary material collects liquid, but not vapor. The capillary material can be arranged within a reservoir to gather dispersed liquid and channel it to a desired location.

Capillary materials function in large part by porosity. The use of the material requires certain design considerations to guide liquid to a specific location instead of simply collecting and retaining the liquid. One known approach to guide the liquid is to construct the capillary material such that pores decrease in size as they approach the desired collection location. Systems operating on this principle can be difficult to design and manufacture such that they work efficiently.

SUMMARY

A passive liquid collecting device includes a reservoir including a reservoir exit line and at least one rigid structure disposed within the reservoir configured to collect a liquid and direct the liquid to the reservoir exit line. A first porous capillary media is supported by the at least one rigid structure and a vapor-liquid separator in contact with at least one of the at least one rigid structure and the first porous capillary media. The vapor-liquid separator includes a guide member extending along a guide member axis having a guide inlet and a guide outlet connected by a spiral conduit. A second porous capillary media is located radially outward from the spiral conduit on an exterior surface of the guide member. A thermal control loop is also disclosed.

These and other features may be best understood from the following drawings and specification.

DETAILED DESCRIPTION

Figure 1:
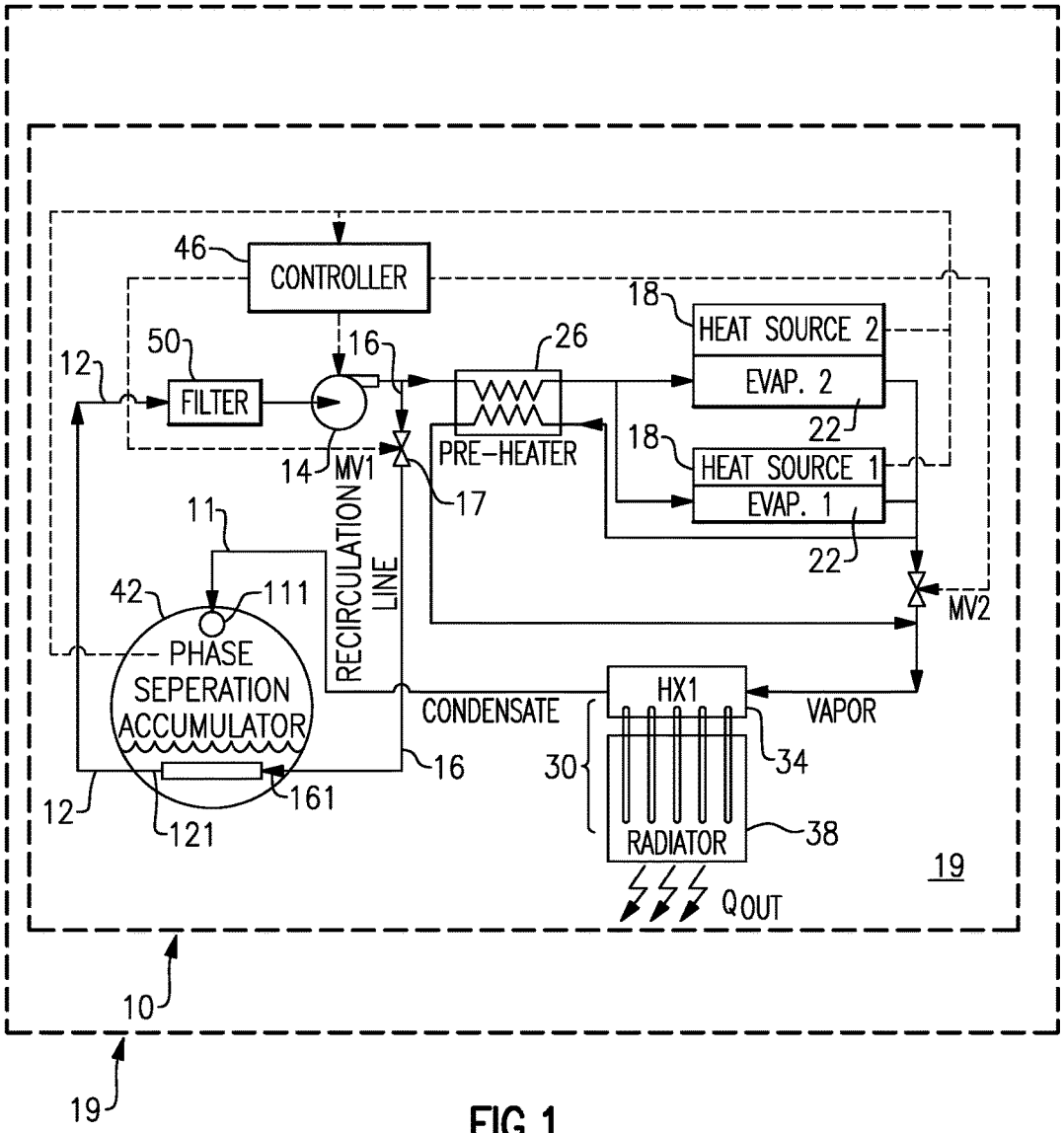
FIG. 1 schematically represents a thermal control loop.

FIG. 1 is a schematic representation of a thermal control loop 10, which may also be referred to as a two phase chiller system. The thermal control loop 10 circulates a refrigerant to remove heat from objects or systems adjacent the thermal control loop 10. In the illustrated embodiment, the thermal control loop 10 is driven by a pump 14, but it should be understood that thermal control loops 10 operating without a pump 14 may also benefit from this disclosure. In the illustrated non-limiting embodiment, the operating capacity of the pump 14 is adjusted by a controller 46 that monitors conditions around the thermal control loop 10. The refrigerant in the thermal control loop 10 cools one or more heat sources 18. In one embodiment, the heat sources 18 are electrical components in a spacecraft 19 that may sometimes operate in a microgravity or zero gravity environment.

The heat sources 18 are cooled with evaporators 22. The evaporators 22 cool the heat sources 18 by evaporating liquid refrigerant. In evaporators 22 the refrigerant undergoes a phase change from a liquid to a vapor. Some heat from the vapor may be communicated to liquid refrigerant earlier in the loop through a recuperator or preheater 26. The preheater 26 exchanges heat from refrigerant in vapor form exiting the evaporators 22 to refrigerant in liquid form upstream of the evaporators 22. The preheater 26 contributes to efficient operation of the thermal control loop 10 by bringing the liquid refrigerant close to an evaporating temperature before it reaches the evaporators 22. The refrigerant in vapor form that exited the evaporators 22 is converted back into liquid by a condenser 30 downstream from the evaporators 22. In one embodiment, the condenser 30 comprises a heat exchanger 34 and a radiator 38 which, respectively, take heat from the refrigerant in vapor form and convey the heat out of the thermal control loop 10.

During steady state operation of the thermal control loop 10, refrigerant in liquid form will exit the condenser 30. During transient conditions when a thermal load on the evaporators 22 is increasing, such as caused by a sudden increase in a temperature of the heat sources 18, more refrigerant in vaporous form will remain in vaporous form after passing through the condenser 30. The increase in refrigerant in vaporous form downstream of the condenser 30 occurs until a new steady state condition is reached in the thermal control loop 10. The new steady state is reached by the controller 46 monitoring the temperature and pressure of an accumulator 42 and the preheater 26 and adjusting a flow of the refrigerant through the thermal control loop 10 with the pump 14.

In the illustrated embodiment, the thermal control loop 10 includes the accumulator 42 downstream of the condenser 30 for separating liquid refrigerant from vaporous refrigerant that passed through the condenser 30 without condensing into liquid form. After passing through the condenser 30, the refrigerant enters the accumulator 42 through a refrigerant inlet passage 11. As detailed below, the accumulator 42 collects refrigerant in liquid form to exit through a refrigerant outlet passage 12. Most of the refrigerant that exits through the refrigerant outlet passage 12, as measured by mass flow rate, is in liquid form.

The thermal control loop 10 also incorporates a recirculation line 16 to accommodate for transient conditions. The recirculation line 16 is fed from a portion of the thermal control loop 10 downstream from the pump 14 and upstream of pre-heater 26 and the evaporator 22. The recirculation line 16 includes a recirculation valve 17 in communication with the controller 46 to maintain internal pressure of the accumulator 42 within acceptable bounds in response to conditions detected within the thermal control loop 10, or to ensure that the accumulator continues to deliver an uninterrupted flow of liquid refrigerant regardless of changing load and transient conditions introduced into the thermal control loop 10. An acceptable pressure and flow of refrigerant is achieved by controlling a volume of pumped liquid refrigerant that the recirculation line 16 returns to the accumulator 42.

The thermal control loop 10 may contain a filter 50 in the refrigerant outlet passage 12 as well for maintaining quality of the liquid refrigerant. The filter 50 is downstream of the accumulator 42 and upstream of the pump 14.

Figure 2A:
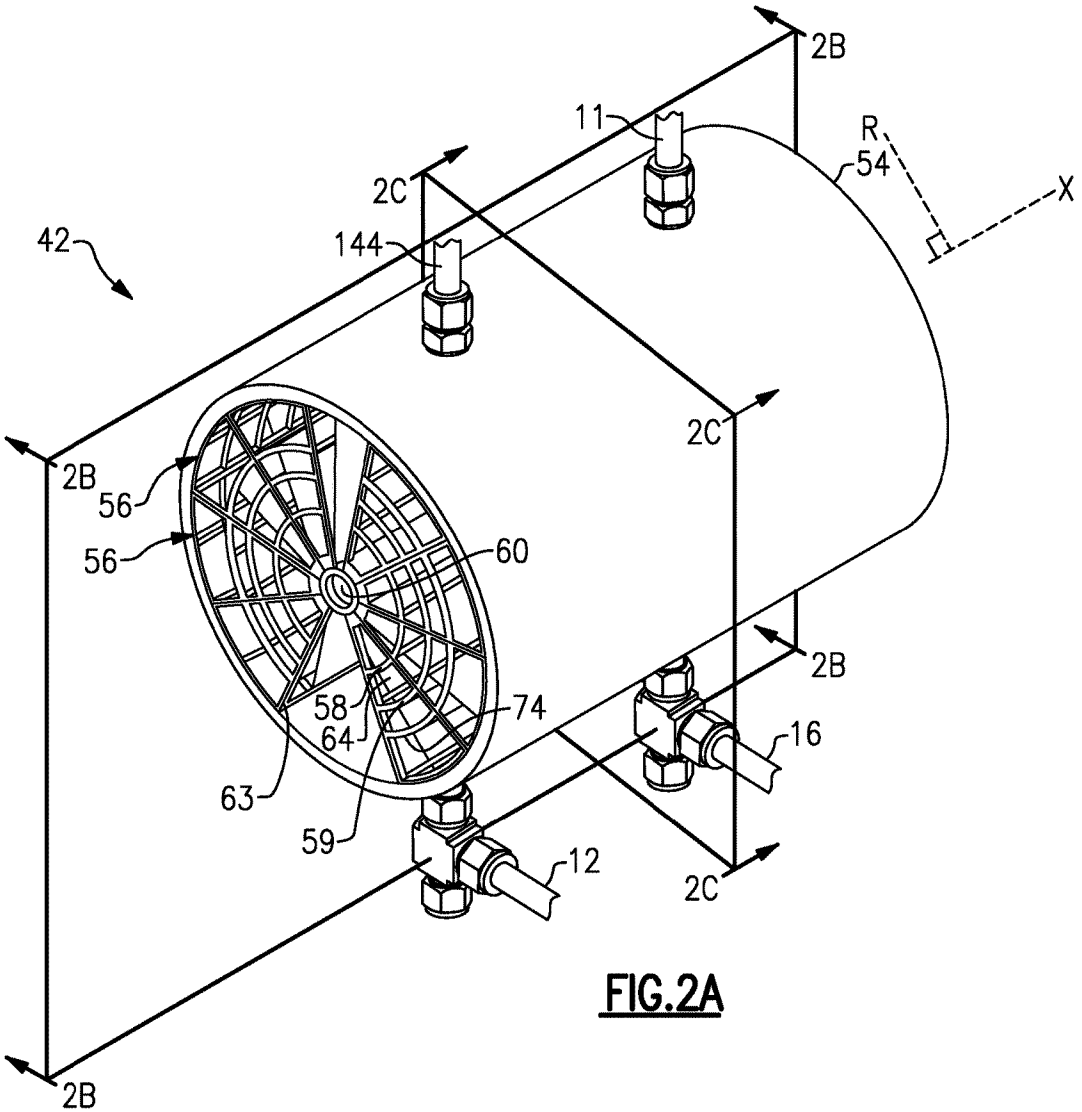
FIG. 2A illustrates an accumulator.

FIG. 2A depicts the accumulator 42. A volume of the accumulator 42 is defined by walls of a reservoir 54. Although the end of the accumulator 42 is shown open, a cap (not shown) could cover the accumulator 42. Within the reservoir 54 are a group of rigid structures 56 arranged circumferentially around a liquid collection tube 60. During operation of the thermal control loop 10, liquid may flow continuously from the liquid collection tube 60, which is made of a porous material, through the refrigerant outlet passage 12. The porous material of the liquid collection tube 60 contributes to a flow of liquid in the reservoir 54. In one embodiment, the rigid structures 56 are constructed from a material chosen to not be reactive with the refrigerant used in the thermal control loop 10.

The reservoir 54 shown in this embodiment has a cylindrical shape, with an axial component extending along a reservoir axis X, and a radial component R extending outward from the reservoir axis X. The group of rigid structures 56 in this embodiment is arranged to also define a roughly cylindrical shape. The rigid structures 56 extends along at least a majority of a length of the reservoir 54 along the reservoir axis X. Each rigid structure 56 also has legs 63 extending from a point where the rigid structure 56 contacts the liquid collection tube 60 to an outermost rib 62. In the illustrated embodiment, the legs 63 extend along a radial direction and extends across at least a majority of a radius of a circular section of the reservoir 54. Because of the axial and radial extension of the rigid structures 56, the cylindrical shape defined by the group of rigid structures 56 in this embodiment extends throughout a significant portion of the reservoir 54. A porous capillary media 64 is wrapped around the rigid structure 56.

It should be understood that, although the reservoir 54 and arrangement of the rigid structures 56 shown in this embodiment are both cylindrical, the reservoir 54 and arrangement of the rigid structures 56 could be of any shape suitable for facilitating liquid travel toward the liquid collection tube 60 without departing from the scope of this disclosure. As an example, the reservoir 54 and the volume defined by the extremities of the rigid structures 56 could define a shape that is rectangular in section.

Figure 2B:
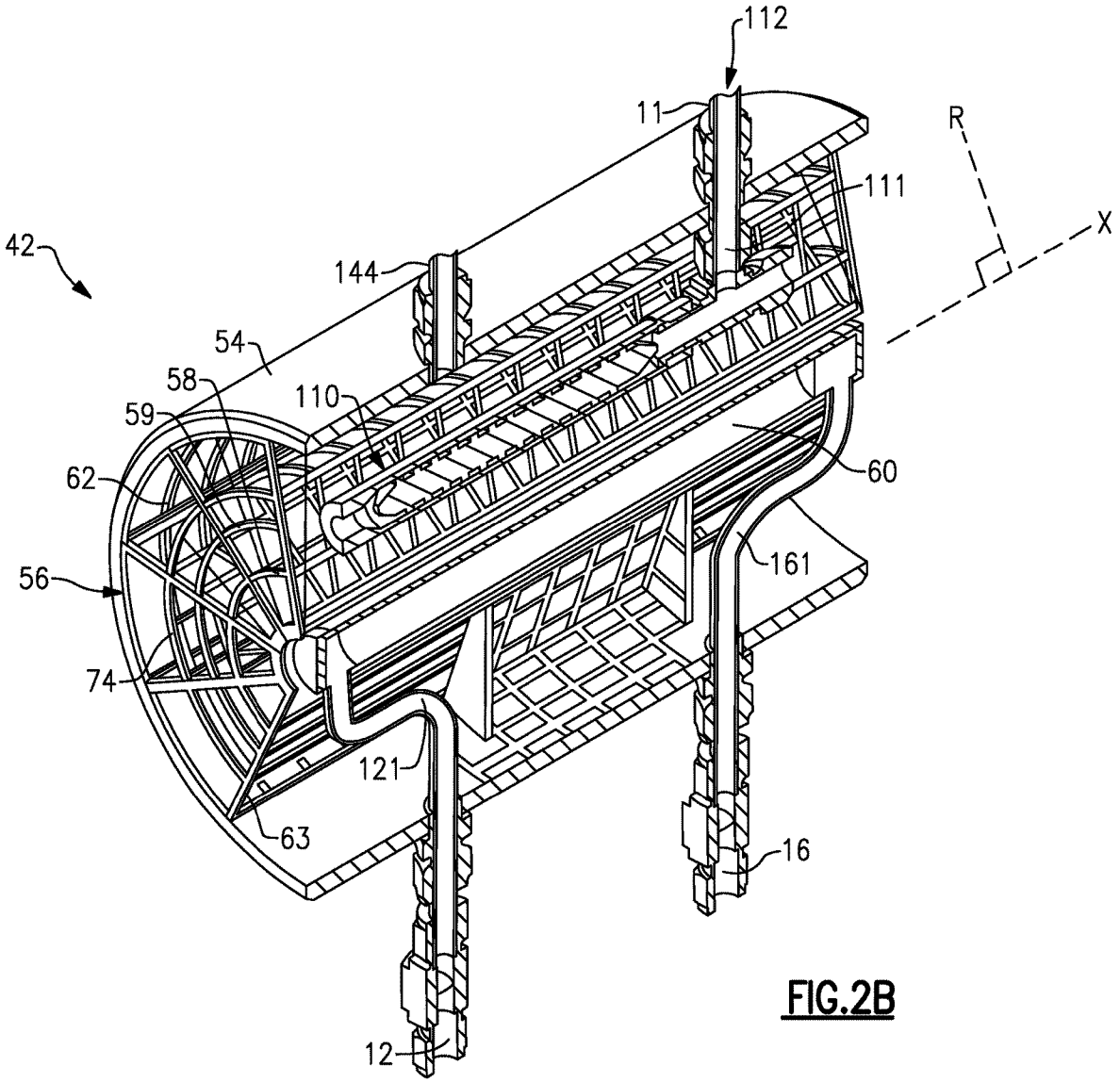
FIG. 2B is a cross-sectional view of the accumulator along plane 2B of FIG. 2A.

A cross-sectional view taken along plane 2B of FIG. 2A is shown in FIG. 2B. The refrigerant inlet passage 11 and refrigerant outlet passage 12 are connected to a reservoir entry line 111 and reservoir exit line 121, respectively, within the reservoir 54. The reservoir entry line 111 in the illustrated embodiment is connected to a vapor-liquid separator 110, which contributes to the separation of vapor and liquids and will be discussed further below and the reservoir exit line 121 is in communication with the liquid collection tube.

The recirculation line 16 is also connected to the liquid collection tube 60 by a recirculation delivery line 161 within the reservoir 54. The recirculation delivery line 161 accommodates for transient conditions in the thermal control loop 10 when a pressure within the reservoir 54 changes and the amount of refrigerant needed traveling through the thermal control loop 10 is changing. Specifically the recirculation delivery line 161 maintains liquid in the liquid collection tube 60 regardless of system conditions. The recirculation delivery line 161 is connected to the liquid collection tube 60 at an opposite end from the reservoir exit line 121.

In addition to the reservoir entry line 111, reservoir exit line 121, and recirculation delivery line 161, the accumulator 42 according to this embodiment has a test port 144. The test port 144 is used to monitor and regulate pressure inside the reservoir 54. To accomplish the monitoring and regulation, the test port may be fitted with apparatus such as a pressure monitoring device and/or pressure relief valve. The test port 144 can also be used to pressurize the accumulator 42 during startup of the thermal control loop 10.

Figure 2C:
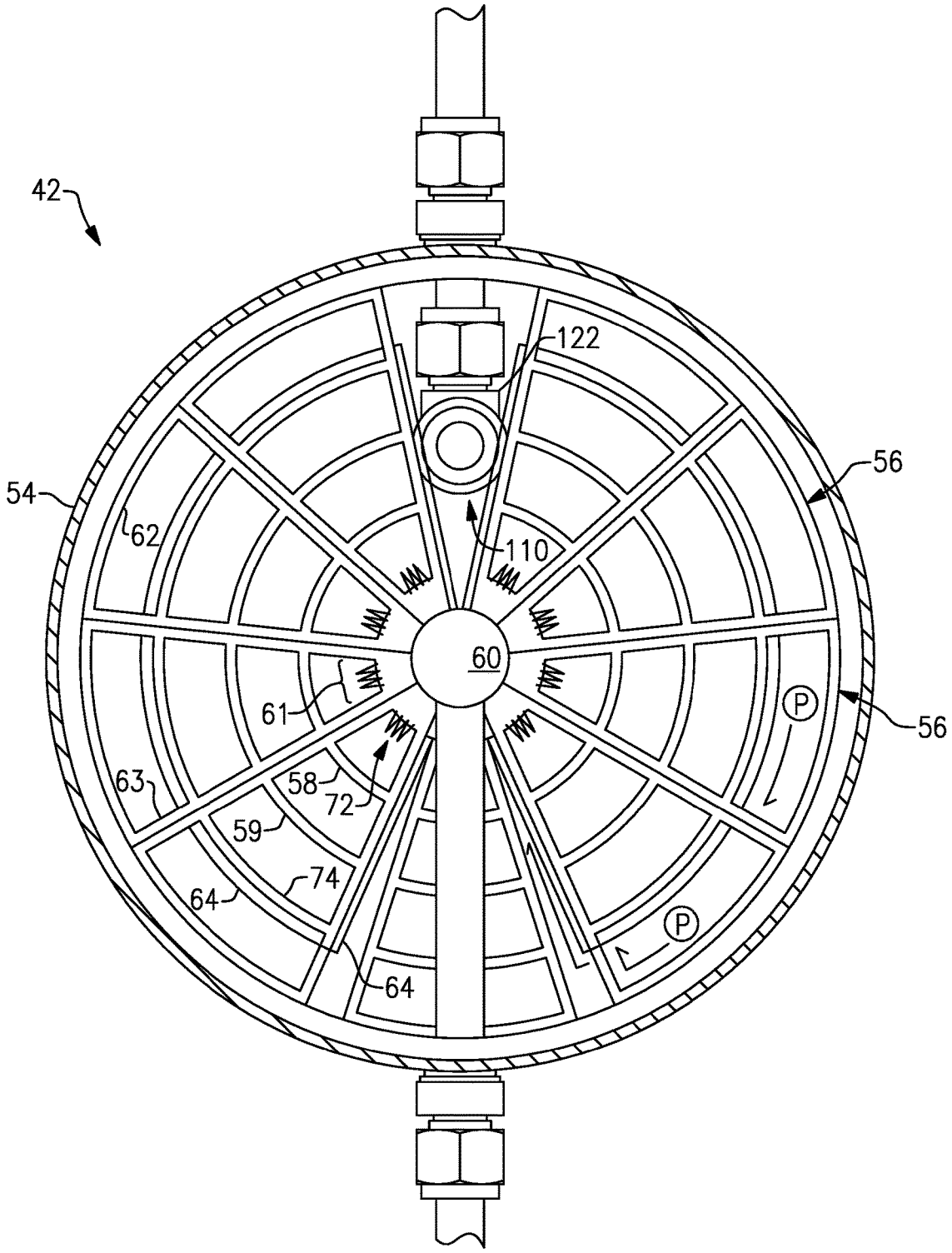
FIG. 2C is a cross-sectional view of the accumulator along plane 2C of FIG. 2A.

FIG. 2C is a cross-sectional view of the accumulator 42 taken along plane 2C of FIG. 2A. Flow paths for example droplets or particles P of liquid refrigerant show how liquid refrigerant may flow from a radially outer area of the reservoir 54 to the liquid collection tube 60. The rigid structures 56 have features which will be discussed further below that facilitate liquid movement across the legs 63. The legs 63, ribs 58, 59, 74, 62, and porous capillary media 64 cooperate to cause liquid to disperse across the rigid structures 56. However, because of flow from the liquid collection tube 60 and liquid collecting features such as corner grooves 72 of the rigid structures 56 near the liquid collection tube 60 that will be detailed below, overall liquid travel will generally go from radially outer portions of the rigid structures 56 to radially inner portions of the rigid structures 56.

As shown, particles P of liquid refrigerant floating in the reservoir 54 may contact the rigid structure 56. If the particle P contacts the rigid structure, it will disperse across the legs 63 or ribs 58, 59, 74 62. If the particle P contacts porous capillary media 64, it will disperse throughout the porous capillary media 64. In either case, dispersion of liquid across the rigid structures 56 or porous capillary media 64 will eventually cause the liquid refrigerant to be collected in the corner grooves 72, which are in fluid communication with the liquid collection tube 60. Because the porous capillary media 64 wrap around the rigid structures 56, parts of the porous capillary media 64 are disposed between the rigid structures 56 and the liquid collection tube 60, putting them in direct contact with the liquid collection tube 60. Because of the direct contact between the porous capillary media 64 and the liquid collection tube 60, liquid refrigerant may also be communicated to the liquid collection tube 60 directly through the porous capillary media 64.

Particles P that contact the rigid structure 56 or porous capillary media 64 between the legs 63 will flow towards a leg 63. Once at the legs 63, the liquid moves radially inwardly along the legs 63 to the liquid collection tube 60.

The vapor-liquid separator 110 is situated near, or attached to, the rigid structures 56 to further facilitate efficient travel of liquid to the liquid collection tube 60. The proximity of the vapor-liquid separator 110 to the rigid structures 56 puts another porous capillary media 122, such as a liquid coalescing medium, on an exterior surface of the vapor-liquid separator 110 into contact with the porous capillary media 64, providing an efficient flow path for liquid refrigerant through the reservoir 54 that will be further detailed below. In the illustrated non-limiting embodiment, the vapor-liquid separator 110 is located between an adjacent pair of rigid structures 56 such that the vapor-liquid separator 110 is in contact with the adjacent pair of rigid structures 56 and the adjacent pair of rigid structures 56 are spaced from each other.

Figure 3:
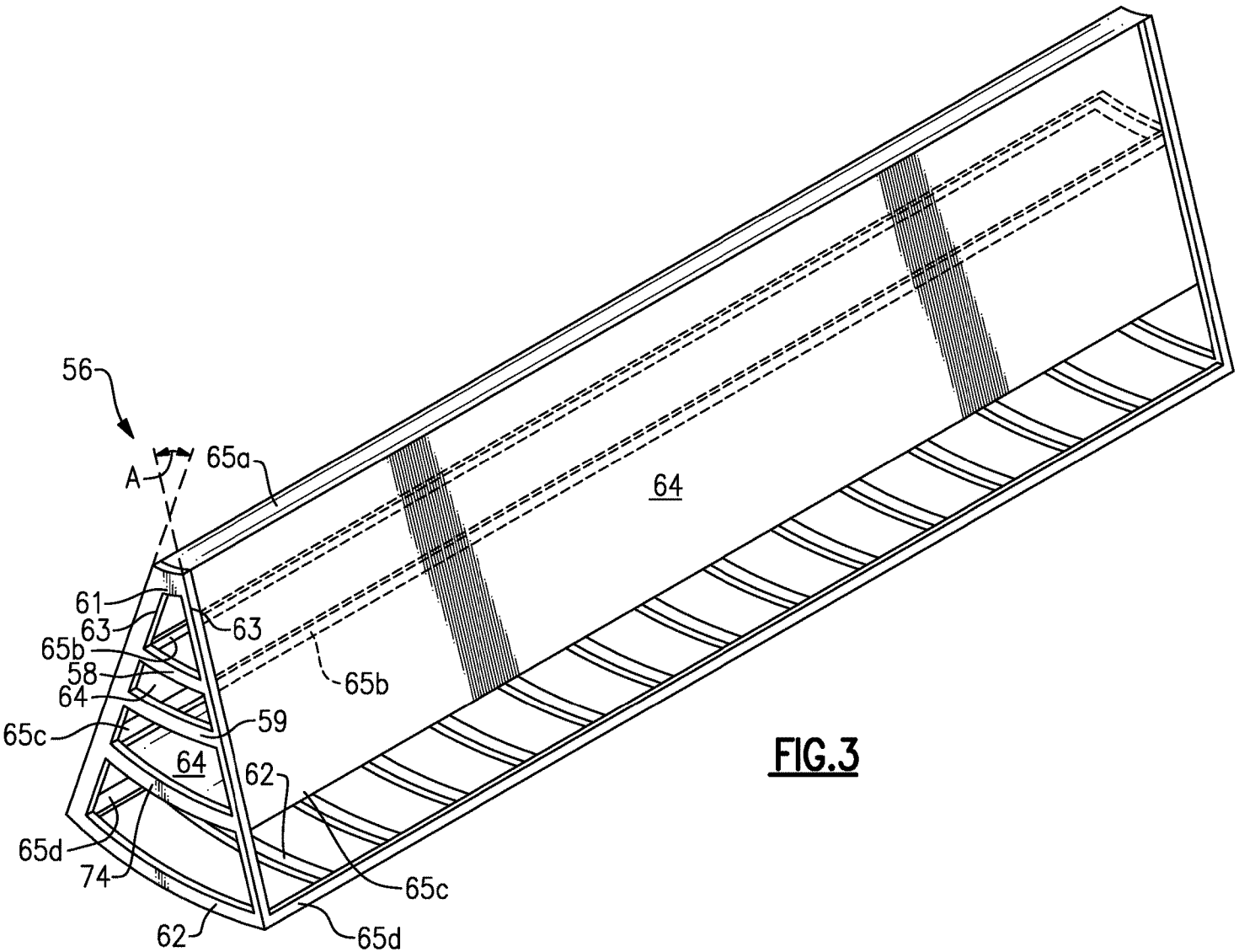
FIG. 3 illustrates a rigid structure suspending porous capillary media.
Figure 4A:
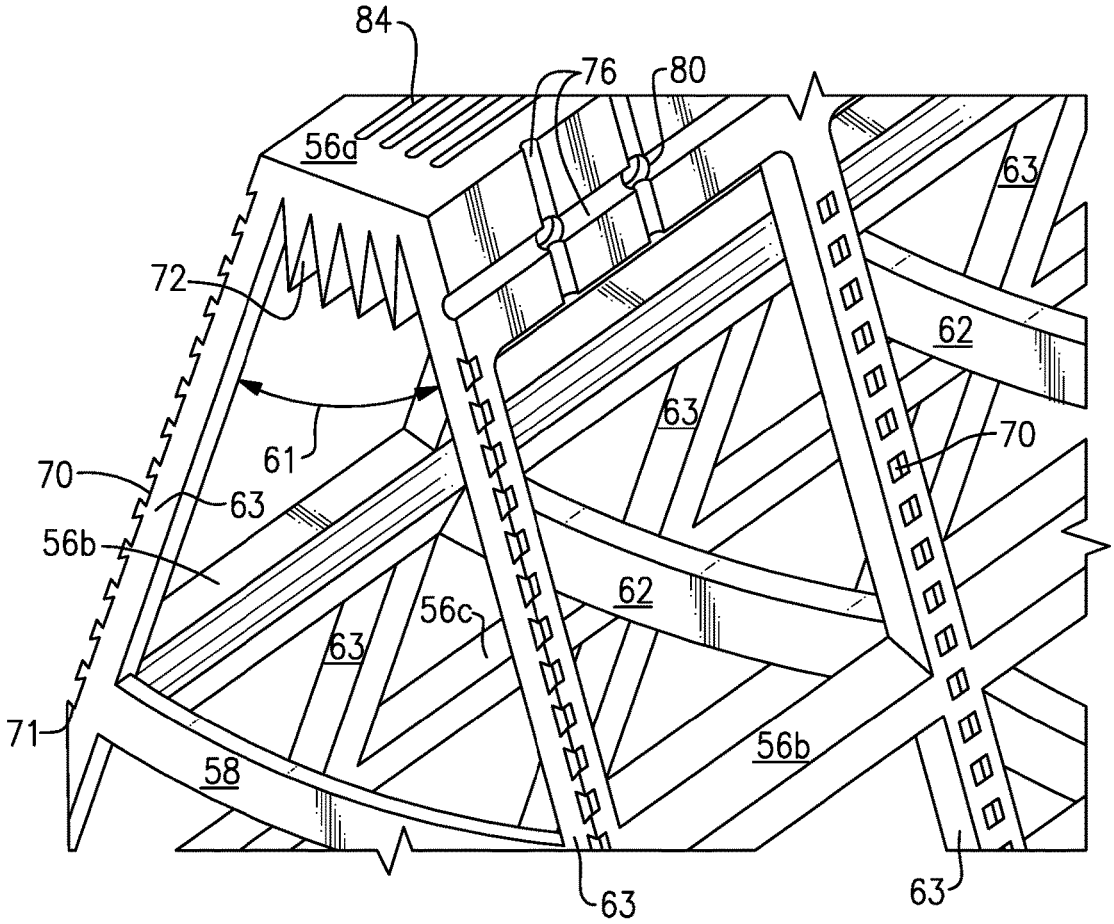
FIG. 4A is an enlarged view of a rigid structure.

As shown in FIGS. 2C, 3, and 4A, the rigid structures 56 are pie shaped in that they have a generally triangular shape except for one arcuate side. The pie shape defines an inner corner 61. The rigid structures 56 include the legs 63 that extend in a radial direction and ribs 58, 59, 74, 62 that extend in a circumferential direction between adjacent legs 63. There are innermost ribs 58, inner middle ribs 59, outer middle ribs 74, and outermost ribs 62. Wrapped around at least a portion of each of the rigid structures 56 is porous capillary media 64 constructed from porous media. Because the porous capillary media 64 is wrapped around portions of rigid structures 56, a shape of the porous capillary media 64 is defined by a shape of the rigid structures 56. In the embodiment shown, the porous capillary media 64 are supported in a group of pie shapes because of the pie shaped rigid structures 56.

In one embodiment, the porous capillary media 64 is formed of multilayer screen mesh, felt, sintered metallic powder, or ceramic. Material for the porous capillary media 64 may be chosen to not be reactive with the refrigerant.

The legs 63 are connected by arms extending in the axial direction. There is an innermost arm 65*a*, inner middle arms 65*b*, outer middle arms 65*c*, and outermost arms 65*d*. In the embodiment shown, the porous capillary media 64 is wrapped around the innermost arm 65*a* and the outer middle arms 65*c*. Thus, porous capillary media 64 enclose the inner middle arms 65*b*, but not the outermost arms 65*d*. In another embodiment, the porous capillary media are wrapped around the inner middle arms 65*b* and innermost arm 65*a* only. Because there is a single innermost arm 65*a* forming a point, the porous capillary media 64 will have a portion near the liquid collection tube 60 with an angle equal to an angle of the inner corner 61.

Faces of the ribs 58, 59, 74, 62, legs 63, and arms 65 of the rigid structure 56 in connection with the porous capillary media 64 form an absorbent system spanning an interior of the reservoir 54. A drop of liquid anywhere in the reservoir 54 should be close to one of the ribs 58, 59, 74, 62, legs 63, arms 65, or porous capillary media 64. Thus, liquid floating in the reservoir 54 will likely come into contact with the rigid structure 56 or the porous capillary media 64 without any outside excitation.

Because the porous capillary media 64 is wrapped on the rigid structure 56, the porous capillary media 64 can maintain a desired shape even if it is flexible or lacks rigidity. The rigid structures 56 provide support for the porous capillary media 64.

One consideration in designing an arrangement of the rigid structures 56 is a contact angle of the liquid refrigerant and an angle of the inner corner 61 of the rigid structures 56 defined by the legs 63. The rigid structure 56 will collect refrigerant if the sum of the liquid refrigerant's contact angle plus half of the angle defined by the inner corner is less than 90°. For example, if the refrigerant is water, and the contact angle of water is 70°, the rigid structure 56 will collect liquid refrigerant if the angle A of the inner corner 61 is less than 40°. Angle A is defined by an extension of the legs 63. Liquids with smaller contact angles would attach to rigid structures 56 a greater angle at the inner corner 61. Thus, the reservoir 54 could be formed with relatively fewer rigid structures 56. In the illustrated embodiment, the angle of the inner corner 61 is 36°.

A contact angle of a liquid varies depending on the surface the liquid is in contact with. Contact angles between many common liquids and surfaces are readily available in technical literature and would be known to a skilled person. Where angles between particular liquids and surfaces are not known or documented in readily available resources, they may be measured by known methods.

FIG. 4A is an enlarged view of a portion of the rigid structure 56 with the porous capillary media 64 removed. Pocket 70 ladders on edges of the legs 63 collect liquid and facilitate fluid movement in a radial direction. The pockets 70 on the left hand side legs 63 are shown cut in half.

Figure 4B:
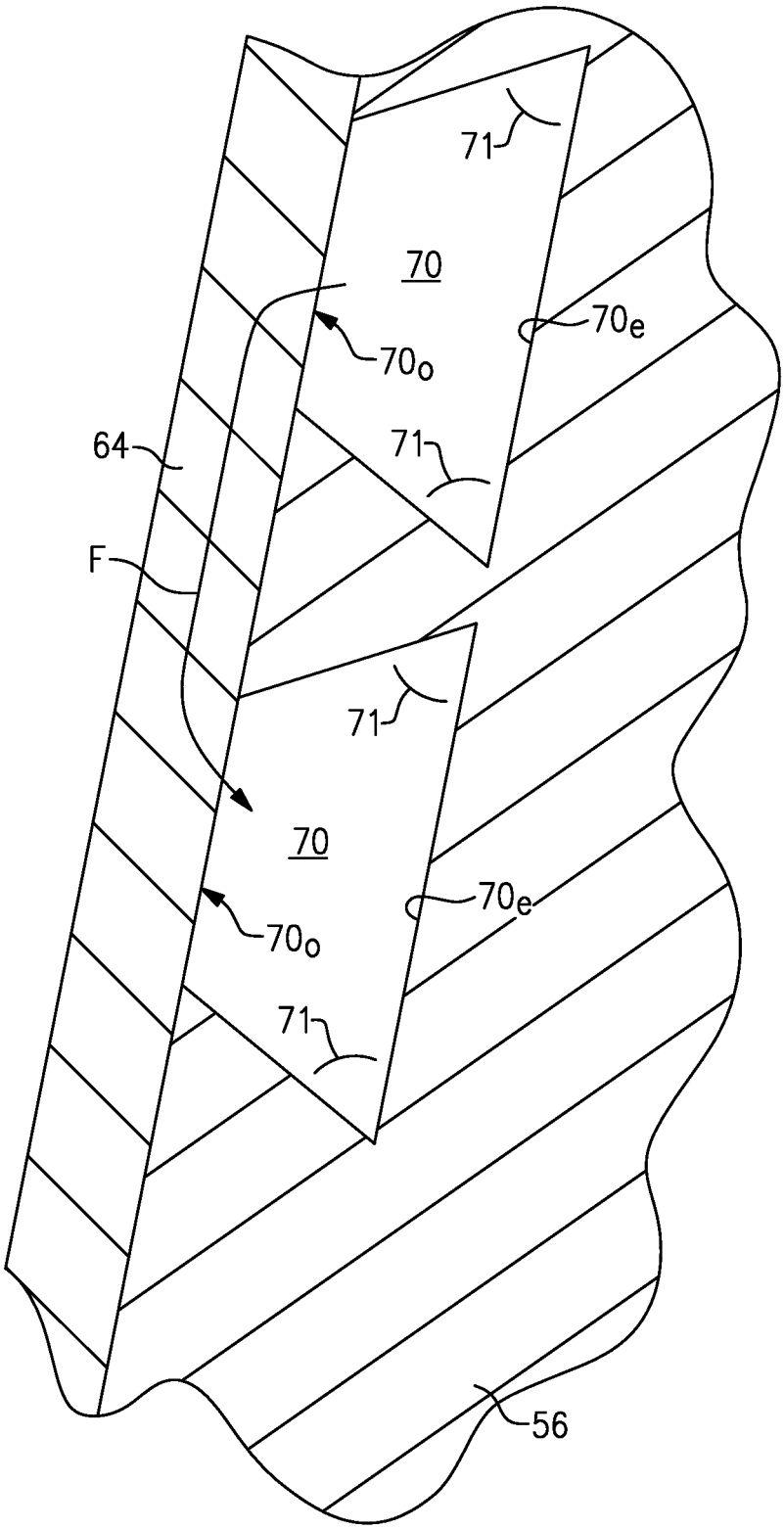
FIG. 4B is an enlarged view of a pocket in the rigid structure.

An exemplary pocket 70 is depicted in a further enlarged view in FIG. 4B. The pockets 70 are shaped to facilitate fluid movement radially inwardly along legs 63. The pockets 70 are wider at an end 70*e* spaced away from their relatively narrow openings 70*o*. In the disclosed example, they have a trapezoidal cross-sectional shape. Further, angles 71 are acute to collect refrigerant. The pockets 70 hold a greater quantity of liquid, and with a greater force, than a flat surface with square edges would. Because the pockets 70 are near each other, liquid will climb from overflowing pockets 70 to adjacent, relatively empty pockets 70 through porous capillary media 64. This is shown schematically at F. In this way, the pockets 70 move liquid radially along the rigid structures 56 even in the presence of adverse external forces, such as gravity.

Figure 4C:
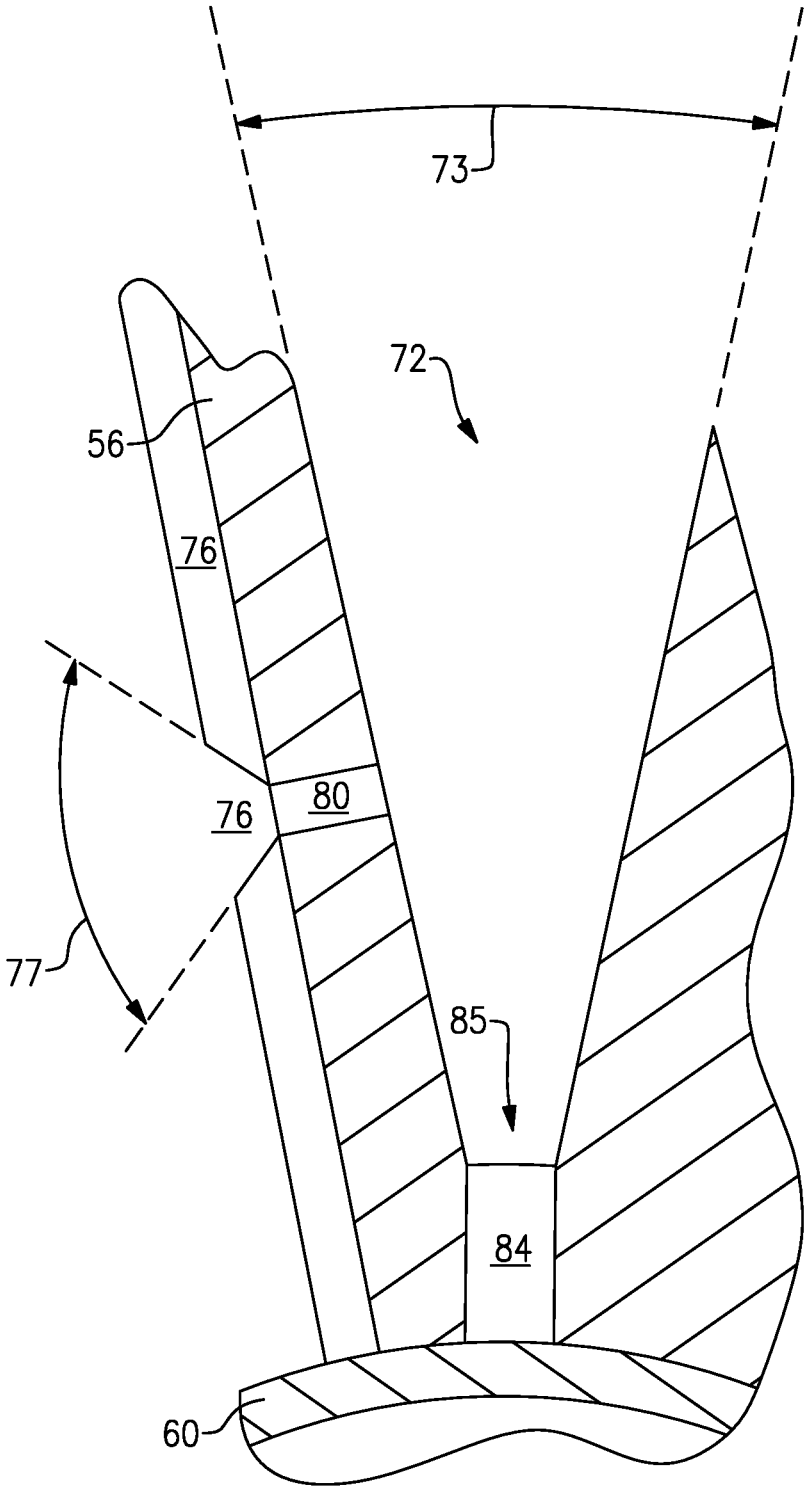
FIG. 4C is an enlarged view of a corner groove in the rigid structure.

Corner grooves 72, side grooves 76, holes 80, and holes 84, shown in another enlarged view in FIG. 4C facilitate fluid movement toward the liquid collection tube 60. The side grooves 76 are in fluid communication with the corner grooves 72 through holes 80. Each corner groove 72 feeds into a hole 84 that is aligned with a trough 85 of the corner groove 72. The holes 84 communicate liquid collected in the corner grooves 72 to the porous tube of the liquid collection tube 60.

Angles 73 defined by the corner grooves 72 and angles 77 defined by the side grooves 76 affect the grooves' 72, 76 efficacy in collecting refrigerant in a liquid state in the same manner as described above with respect to the angle A at the inner corner 61 and the rigid structures 56. To collect refrigerant in a liquid state, the grooves 72, 76 may have acute angles and be constructed such that the sum of a liquid refrigerant contact angle, plus half of the angle 73, 77 defined by the grooves 72, 76 is less than 90°. Phrased another way, if half of either angle 73 or 77 is subtracted from 90°, the difference may be greater than the contact angle of the liquid refrigerant. For example, if the liquid refrigerant is water with a contact angle of 70°, the difference between 90° and the contact angle of the refrigerant is 20°. If the difference is 20°, the angles 73, 77 should each be less than 40°, because 20° is half of 40°. In one embodiment, the angles 73, 77 are 36°.

The rigid structures 56 and porous capillary media 64 work together to create a flow of liquid to the liquid collection tube 60. As liquid near the liquid collection tube 60 is drawn into the liquid collection tube 60, and out of the reservoir 54, the continuous flow will drive liquid collected elsewhere on the rigid structure 56 toward the liquid collection tube 60. The flow of liquid from the liquid collection tube 60 is accomplished without requiring any external power to excite the liquid.

The above described structure will result in the great bulk of refrigerant leaving the reservoir 54 refrigerant outlet passage 12 to be refrigerant in a liquid form, but other apparatus could facilitate more efficient collection of liquid by the accumulator. For example, as shown in FIG. 2B, the mixture of liquid and vaporous refrigerant could enter the accumulator 42 through a vapor-liquid separator 110 that uses momentum of a flowing mixture to separate vapor from liquid.

Figure 5:
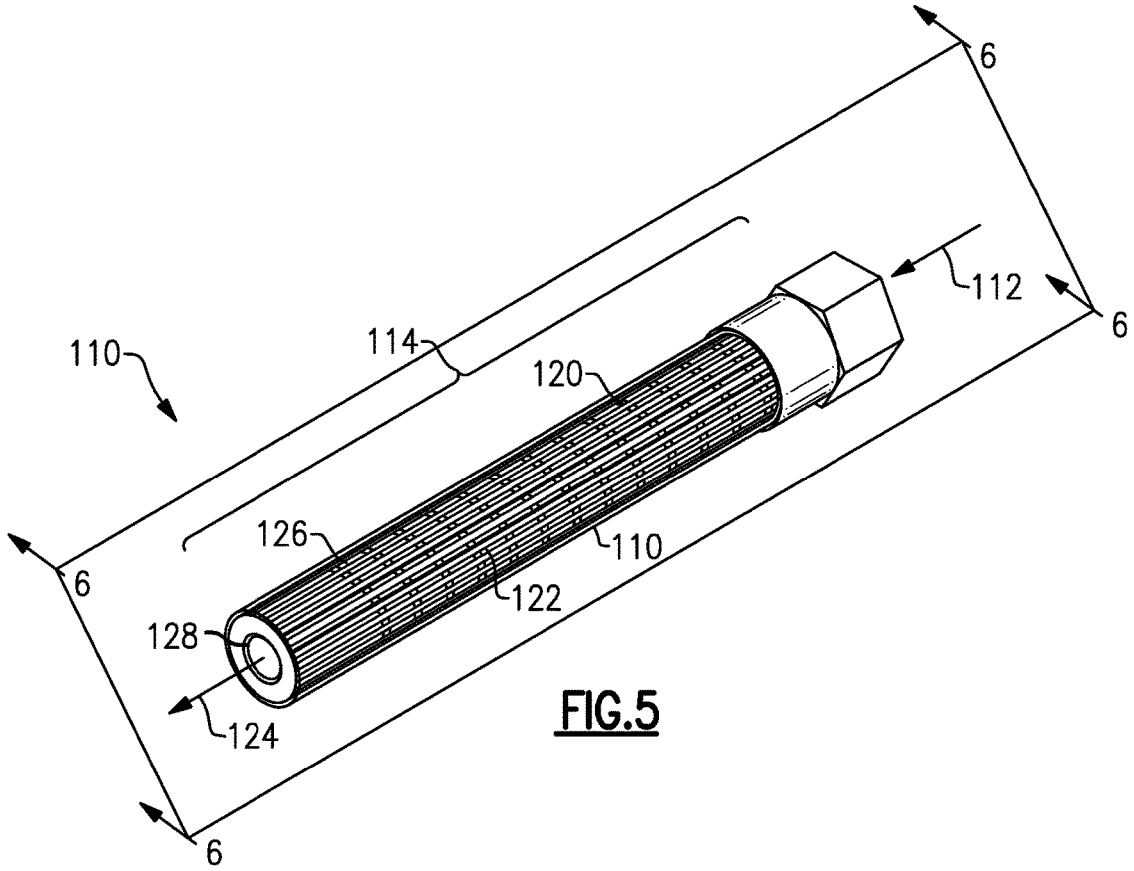
FIG. 5 is a schematic depiction in a perspective view of an example embodiment of a vapor-liquid separator.
Figure 6:
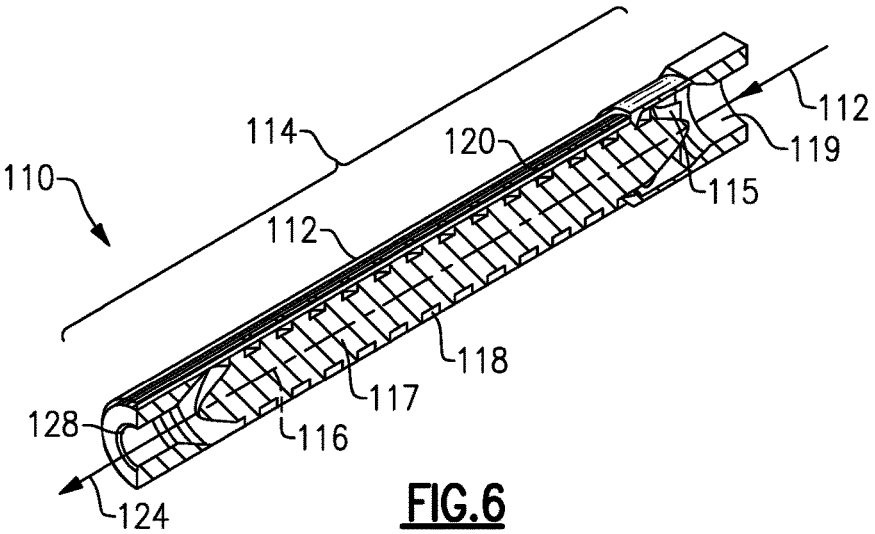
FIG. 6 is a perspective cross-section view of the vapor-liquid separator along plane 6 of FIG. 5.

FIGS. 5-8 schematically depict the details of a non-limiting embodiment of the vapor-liquid separator 110. FIG. 5 shows an exterior surface of a vapor-liquid separator 110, having a plurality of radial channels 120 and the porous capillary media 122. FIG. 6 is a cross-sectional view taken along plane 6 of FIG. 5. As shown in FIG. 6, a fluid mixture 112 comprising a vapor and a liquid from the condenser 30 enters a guide inlet 119 of a guide member 114. The fluid mixture 112 then passes through the guide member 114 to produce a relatively liquid-depleted mixture 124 at a guide outlet 128 of the guide member 114, shown in FIG. 5.

The plurality of radial channels 120 extend radially through the exterior surface of the guide member 114 such that an interior space, such as an elongated spiral conduit 118 (FIG. 6) within the guide member 114 is in fluid communication with the porous capillary media 122 disposed on the exterior surface of the guide member 114. In the illustrated non-limiting embodiment, the radial channels 120 are in a spiral arrangement on the guide member 114 and follow the spiral of the spiral conduit 118 (FIG. 6). The guide member 114 according to the illustrated embodiment also has axial grooves 126 facilitating dispersal of liquid along the exterior surface of the guide member 114.

The length of the spiral conduit 118, the number and configuration of the radial channels 120, and the configuration of the porous capillary media 122 can be specified according to design parameters to produce the desired degree of vapor and liquid depletion in the fluids exiting the vapor-liquid separator 110 at anticipated operating conditions.

FIG. 6 is a cross-sectional view taken along plane 6 of FIG. 5. As shown in the illustrated embodiment, a path between the guide inlet 119 for the fluid mixture 112 and the guide outlet 128 for liquid-depleted mixture 124 generally extends along a guide member axis 116. In the illustrated embodiment, the guide member axis 116 extends longitudinally through a center of the vapor-liquid separator 110.

An interior structure 117 of the guide member 114 is disposed along the guide member axis 116 and defines a spiral conduit 118 within the guide member 114. The spiral shape of the spiral conduit 118 is disposed along the guide member axis 116, and aligns with the spiral arrangement of the radial channels 120. In the illustrated non-limiting embodiment, the interior structure 117 only defines a single spiral conduit 118. However, in another embodiment, the vapor-liquid separator 110 could include more than one spiral conduit 118 offset from each other defined by the interior structure 117 within the guide member 114.

The spiral conduit 118 imparts a centrifugal momentum to the flowing fluid mixture 112 to separate the liquid component from the vapor in the fluid mixture 112 in microgravity or zero gravity environments. Because a liquid phase of most substances will have greater mass density than the vapor phase, the liquid will generally have more momentum than the vapor. Accordingly, the greater momentum of the liquid flowing through the spiral conduit 118 will tend to force the liquid to gather toward the radially outer side of the spiral conduit 118 and travel through the radial channels 120 and come into contact with the porous capillary media 122. Conversely, the portion of the fluid mixture 112 that is relatively vapor-rich and fluid-depleted will remain near the radially inner side of the spiral conduit 118 and will become the relatively liquid-depleted mixture 124 leaving the guide outlet 128 of the vapor-liquid separator 110.

The vapor-liquid separator 110 contributes to more efficient collection of liquid by the accumulator 42 when employed to process the refrigerant entering the reservoir 54. The vapor-liquid separator 110 described herein can be utilized in a variety of environments and applications. The vapor-liquid separator 110 can be disposed in a microgravity environment, where it can in some embodiments provide phase separation without moving parts and without assistance from gravity. Further, the vapor-liquid separator 110 would have utility in a two-phase heat transfer system.

Figure 7:
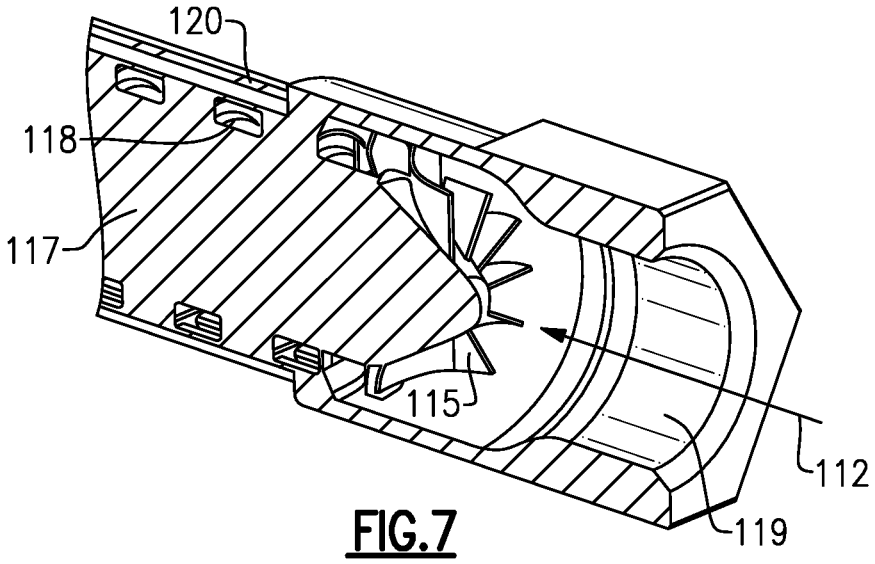
FIG. 7 is an enlarged view of an inlet to the vapor-liquid separator of FIG. 6.

FIG. 7 is an enlarged view of FIG. 6 showing the fluid mixture 112 entering the vapor-liquid separator 110. Guide vanes 115 at the inlet to the spiral conduit 118 deflect the fluid mixture 112 from the relatively linear path at the guide inlet 119 to a rotating path or spiral path into the spiral conduit 118. The guide vanes 115 introduce a rotating vector smoothly, creating less turbulence and pressure drop than would result from sending a linear flow of the fluid mixture 112 directly into the spiral conduit 118. In another embodiment, the guide vanes 115 could be eliminated and the fluid mixture 112 could enter the vapor-liquid separator 110 in a direction perpendicular or transverse to the guide member axis 116 to induce rotation into the fluid mixture 112 and encourage the fluid mixture 112 to follow the spiral conduit 118.

Figure 8:
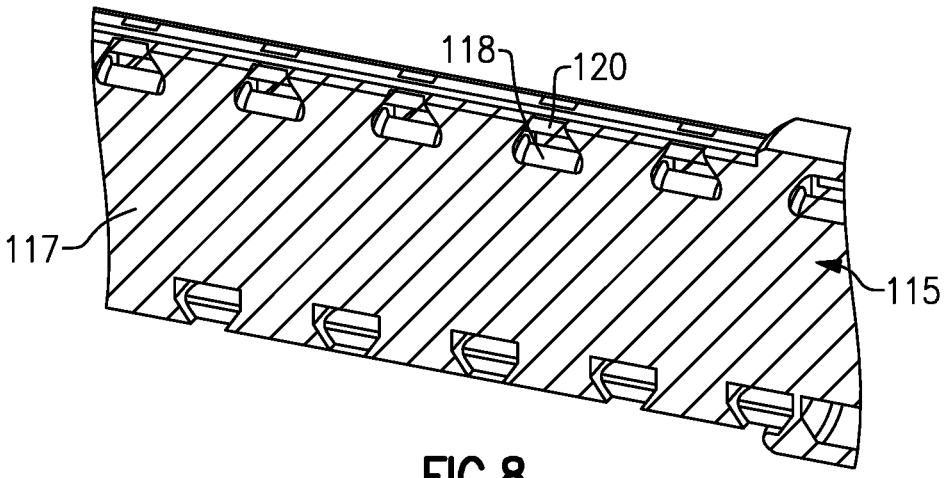
FIG. 8 is an enlarged view of a mid-portion of the vapor-liquid separator of FIG. 6.

FIG. 8 is an enlarged view of the interior structure 117 from FIG. 6. As shown, the radial channels 120 open into the spiral conduit 118. Further, the spiral conduit 118 is tapered such that it is narrower at its radially outward side adjacent the radial channels 120. If the spiral conduit 118 tapers enough, it could create a liquid wicking corner according to principles discussed above regarding the angles 73, 77 of various features of the rigid structures 56. The surfaces of the spiral conduit 118 may be composed of or coated with a material wettable by the liquid in the fluid mixture 112. The centrifugal force, tapered shape, and wettable surface of the spiral conduit 118 all contribute to efficient collection of liquid from the fluid mixture 112 at the radially outer side of the fluid conduit 118 and, as a result, communication of the liquid from the spiral conduit 118 through the radial channels 120 to the porous capillary media 122 on the exterior of the vapor-liquid separator 110.

A wide variety of options for structure and composition of the porous capillary media 122 is contemplated herein. The porous capillary media 122 can be selected from any of a wide variety of porous media, including but not limited to mesh screens or pads made of various materials such as metal or plastic, woven or non-woven fiber pads, open-cell foams made of various materials such as metal, plastic, or composite materials. The dimensions of the porous capillary media 122 can vary depending on the specific properties of the liquid (e.g., density, surface tension properties, etc.) and the vapor, and on process design parameters including but not limited to mass flow rates and flow velocities. In some embodiments, the dimensions or materials of the porous capillary media 122 can vary radially relative to the guide member axis 116. For instance, the porous capillary media 122 can have larger openings (e.g., coarser mesh) relatively closer to the guide member axis 116 and smaller openings (e.g., finer mesh) relatively farther from the guide member axis 116.

Figure 9:
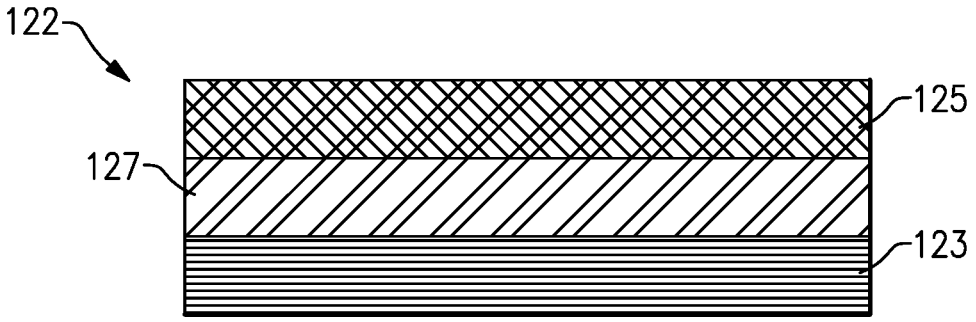
FIG. 9 is a cross-sectional view of a schematic representation of a multilayer porous capillary media.

As depicted in FIG. 9, the porous capillary media 122 includes a first screen mesh layer 123, and a second screen mesh layer 125 radially outward from the first screen mesh layer and having a finer mesh size than the first screen mesh layer. In the illustrated embodiment, the porous capillary media 122 also includes a third screen mesh layer 127 disposed between the first and second screen mesh layers 123, 125. The third screen mesh layer 127 includes a finer mesh size than the first screen mesh layer 123 and a courser mesh size than the second screen mesh layer 125. The first, second, and third screen mesh layers 123, 125, and 127 can have any mesh sizes suitable for a given application, but in one exemplary embodiment the first screen mesh layer 123 has a mesh size of 20 μm to 50 μm, the second screen mesh layer 125 has a mesh size of 1 μm to 5 μm, and the third screen mesh layer 127 has a mesh size of 5 μm to 20 μm. Any of the above described radial variations could also be applied axially relative the guide member axis 116 to accommodate different conditions as the fluid mixture 112 flows along the spiral conduit 118.

During operation of the thermal control loop 10, a mixture of liquid and vapor forming the fluid mixture 112 can exit the condenser 30 and enter the accumulator 42. Because vaporous refrigerant can damage the pump 14, the accumulator 42 is utilized to separate the vapor from the liquid and provide a liquid refrigerant to the pump 14. The fluid mixture 112 will initially pass through the vapor-liquid separator 110 in the accumulator 42 which will direct the fluid mixture 112 through the spiral conduit 118. A liquid portion of the fluid mixture 112 will flow out of the spiral conduit 118 through the radial channels 120 and the liquid-depleted mixture 124 will exit the vapor-liquid separator 110 through the guide outlet 128. The liquid-depleted mixture 124 collects in the reservoir 54. The vapor-depleted or mostly liquid phase of the fluid mixture 112 in the axial grooves 126 and the radial channels 120 disposed on the outer surface of the vapor-liquid separator 110 is collected by the porous capillary media 122. The liquid-depleted mixture 124 collected by the reservoir 54, will be further processed by the rigid structures 56 and/or porous capillary media 64 as discussed above.

The liquid in the porous capillary media 122 will transfer to the rigid structures 56 because of the proximity of the porous capillary media 122 to the rigid structures 56 and the porous capillary media 64 located on the rigid structures 56. In one embodiment, the porous capillary media 64 includes a finer mesh size than mesh size of the porous capillary media 122, causing liquid within the porous capillary media 122 to travel to the porous capillary media 64 due to capillary forces. From the rigid structures 56, the liquid travels to the liquid collection tube 60 and out the reservoir exit line 121 towards the pump 14.

Additionally liquid refrigerant enters the accumulator 42 through the recirculation delivery line 161, which is in communication with the recirculation line 16. The recirculation delivery line 161 allows liquid refrigerant to pass through the liquid collection tube 60 with at least a portion of the liquid leaving the accumulator 42 through the reservoir exit line 121 depending on the transient needs of the thermal control loop 10.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A passive liquid collecting device comprising:
- a reservoir including a reservoir exit line;
- at least one rigid structure disposed within the reservoir and configured to collect a liquid and direct the liquid to the reservoir exit line;
- a first porous capillary media supported by the at least one rigid structure; and
- a vapor-liquid separator in contact with at least one of the at least one rigid structure and the first porous capillary media including:
  - a guide member extending along a guide member axis having a guide inlet and a guide outlet connected by a spiral conduit; and
  - a second porous capillary media located radially outward from the spiral conduit on an exterior surface of the guide member.

2. The passive liquid collecting device of claim 1, wherein the vapor-liquid separator includes a plurality of radial channels providing radial flow paths for fluid from the spiral conduit to the second porous capillary media.

3. The passive liquid collecting device of claim 2, wherein the radial channels are in a spiral arrangement aligned with the spiral conduit.

4. The passive liquid collecting device of claim 1 wherein the spiral conduit includes at least one tapered portion that tapers from a radially inward to a radially outward direction relative to the guide member axis.

5. The passive liquid collecting device of claim 1, further comprising a reservoir entry line flowing into the vapor-liquid separator and a porous liquid collection tube that feeds into the reservoir exit line.

6. The passive liquid collecting device of claim 5, further comprising a pumped liquid recirculation line that flows into the liquid collection tube.

7. The passive liquid collecting device of claim 1, wherein the at least one rigid structure includes multiple rigid structures arranged circumferentially around a porous liquid collection tube leading to the reservoir exit line.

8. The passive liquid collecting device of claim 7, wherein the liquid has a contact angle, the rigid structures have a corner with a corner angle, and the sum of the contact angle and half of the corner angle is less than 90°.

9. The passive liquid collecting device of claim 1, wherein the reservoir has a cylindrical shape, and a leg portion of the at least one rigid structure extends along a circular cross-section of the reservoir in a direction that is radial relative to the circular cross-section and the leg portion includes a plurality of pockets in a linear arrangement configured to facilitate liquid motion in a radial direction.

10. The passive liquid collecting device of claim 1, wherein the at least one rigid structure includes grooves at an inner corner defining an acute angle forming a trough and each trough is aligned with a hole that is in fluid communication with the reservoir exit line.

11. The passive liquid collecting device of claim 1, wherein the rigid structure includes side grooves defining acute angles and corner grooves with acute angles, and the side grooves have holes in fluid communication with the corner grooves, and the corner grooves have holes in fluid communication with the reservoir exit line.

12. The passive liquid collecting device of claim 1, wherein the second porous capillary media directly contacts the first porous capillary media and the first porous capillary media includes a finer mesh size than a mesh size of the second porous capillary media.

13. The passive liquid collecting device of claim 12, wherein the vapor-liquid separator is located between an adjacent pair of rigid structures.

14. A thermal control loop, comprising:

a pump for pumping a liquid refrigerant;

an evaporator for removing heat from a heat source and transferring heat to the liquid refrigerant;

a condenser for removing heat from the liquid refrigerant; and an accumulator comprising:

a reservoir including a reservoir exit line;

at least one rigid structure disposed within the reservoir and configured to collect a liquid and direct the liquid to the reservoir exit line;

a first porous capillary media supported by the at least one rigid structure; and a vapor-liquid separator in contact with at least one of the at least one rigid structure and the first porous capillary media including:

a guide member extending along a guide member axis having a guide inlet and a guide outlet connected by a spiral conduit; and a second porous capillary media located radially outward from the spiral conduit on an exterior surface of the guide member.

15. The thermal control loop of claim 14, further comprising a reservoir entry line feeding into the vapor-liquid separator, a porous liquid collection tube that feeds into the reservoir exit line, and a pumped liquid recirculation line that flows into the porous liquid collection tube.

16. The thermal control loop of claim 15, further comprising a controller in communication with a recirculation valve on the pumped liquid recirculation line, wherein the controller is configured to operate the recirculation valve in response to detected conditions in the thermal control loop.

17. The thermal control loop of claim 14, wherein the first porous capillary media directly contacts the second porous capillary media.

18. The thermal control loop of claim 17, wherein the first porous capillary media includes a finer mesh size than a mesh size of the second porous capillary media.

19. The thermal control loop of claim 14, wherein the reservoir includes a test port fitted with a pressure monitor.

20. The thermal control loop of claim 14, wherein the reservoir includes a test port fitted with a pressure relief valve.

* * * * *